United States Patent [19]

Greene et al.

[11] Patent Number: 4,542,622

[45] Date of Patent: Sep. 24, 1985

[54] VARIABLE AREA INLET GUIDE VANES

[75] Inventors: Walter Greene, South Windsor; William R. Liebke, Vernon, both of Conn.

[73] Assignee: United Technologies Corporation, Hartford, Conn.

[21] Appl. No.: 400,787

[22] Filed: Jul. 22, 1982

[51] Int. Cl.[4] ..... F02C 3/00; B05B 7/10

[52] U.S. Cl. ..... 60/39.23; 60/748; 239/406

[58] Field of Search ..... 60/39.23, 748, 39.29, 60/726; 239/403, 404, 405, 406

[56] References Cited

U.S. PATENT DOCUMENTS

| | | | |
|---|---|---|---|
| 2,827,761 | 3/1958 | Schirmer et al. | 60/39.29 |
| 3,570,242 | 3/1971 | Leonardi et al. | 60/748 X |
| 3,958,416 | 5/1976 | Hammond, Jr. et al. | 60/39.23 X |
| 4,054,028 | 10/1977 | Kawaguchi | 60/39.23 |
| 4,290,558 | 9/1981 | Coburn et al. | 60/728 X |
| 4,296,599 | 10/1981 | Adamson | 60/39.23 |

*Primary Examiner*—Carlton R. Croyle
*Assistant Examiner*—Jeffrey A. Simenauer
*Attorney, Agent, or Firm*—Norman Friedland

[57] ABSTRACT

A self-actuating nozzle guide vane assembly for a turbine type power plant fuel nozzle increases airflow during the higher power regimes. The fuel nozzle inlet guides employ primary and secondary swirlers where the primary swirlers continuously deliver compressor air around the fuel nozzles and the secondary swirlers deliver compressor air solely when the pressure drop across the front end of the burner reaches a predetermined level in one embodiment or the inlet temperature goes above a predetermined threshold value in another embodiment.

2 Claims, 5 Drawing Figures

VARIABLE AREA INLET GUIDE VANES

DESCRIPTION

1. Technical Field

This invention relates to combustion systems for gas turbine engines and particularly to the inlet guide vanes (swirlers) that deliver compressor discharge air to the fuel nozzles.

2. Background Art

In recent years, a great deal of effort has been expended to achieve a relatively smokeless burner for gas turbine engine powered aircraft. The dark exhaust of the aircraft has been not only unsightly, but has been objectionable. Of course, it is of paramount importance that the cure of the smoke problem does not increase other unwanted emissions, such as carbon monoxide (CO) and total hydrocarbons (THC) or unburned hydrocarbons (UHC) which is a circumstance known to happen.

It is known in the art to vary the area of the air inlet of the combustor so as to achieve a low output of particulate matter. For example, U.S. Pat. No. 3,982,392 granted to D. E. Crow on Sept. 28, 1976 discloses a combustor designed to vary the area of the air inlet for such a purpose.

We have found that we can provide an improved combustor that exhibits a satisfactory smokeless type of burner without introducing pollutants in the exhaust, by providing a more simplified variable area air inlet control to the combustor. It is contemplated that two concentric sets of inlet guide vanes will be used to supply air to the fuel nozzles, a primary set that continuously feeds swirling air to the combustor and a secondary set that automatically opens upon a given engine operating mode. Hence when operating at low power conditions the secondary air inlet will be in the off condition and when the combustor reaches a predetermined pressure or temperature level, the secondary air inlet will automatically open.

According to the invention, the area controller may be made to be either responsive to pressure or temperature. In the first instance when the pressure differential across the secondary air inlet valve reaches a predetermined pressure drop as established by a spring bias, the valve will automatically open to introduce secondary swirling air to the burner. In the other embodiment, a bimetal valve responding to a given temperature will perform the same function. In either embodiment, the threshold level of the pressure drop or temperature is occasioned whenever operating at the higher thrust conditions.

DISCLOSURE OF INVENTION

An object of this invention is to provide for a combustor of a gas turbine engine an automatic means for varying the air inlet of the combustor primary zone. A feature of this invention is that the air inlet is opened and closed in one preferred embodiment as a function of the pressure drop across the combustor and in another preferred embodiment as a function of the inlet temperature level of the combustor.

Other features and advantages will be apparent from the specification and claims and from the accompanying drawings which illustrate an embodiment of the invention.

BEST MODE FOR CARRYING OUT THE INVENTION

This invention has particular utility with an aerating type of fuel nozzle that utilizes air in close proximity to fuel to improve fuel spray quality in an aerating type of fuel nozzle. Such a fuel system, for example, is utilized in engines exemplified by the JT9D manufactured by Pratt & Whitney Aircraft Group of United Technologies Corporation, the assignee of this patent application, and which is incorporated by reference herein and details of a suitable fuel nozzle are disclosed in U.S. Pat. No. 4,290,558 granted to R. E. Coburn, R. M. Gabriel and R. S. Tuthill on Sept. 22, 1981 and also assigned to United Technologies Corporation.

Inasmuch as the pollutants like CO and UHC occur primarily during idle operation as a result of lean fuel-air mixtures and maximum smoke occurs at high power engine operations, due to the rich fuel-air mixtures, this invention contemplates increasing combustor airflow solely during the high power condition thereby minimizing smoke without any attendant increase in CO and UHC.

Figure 1:
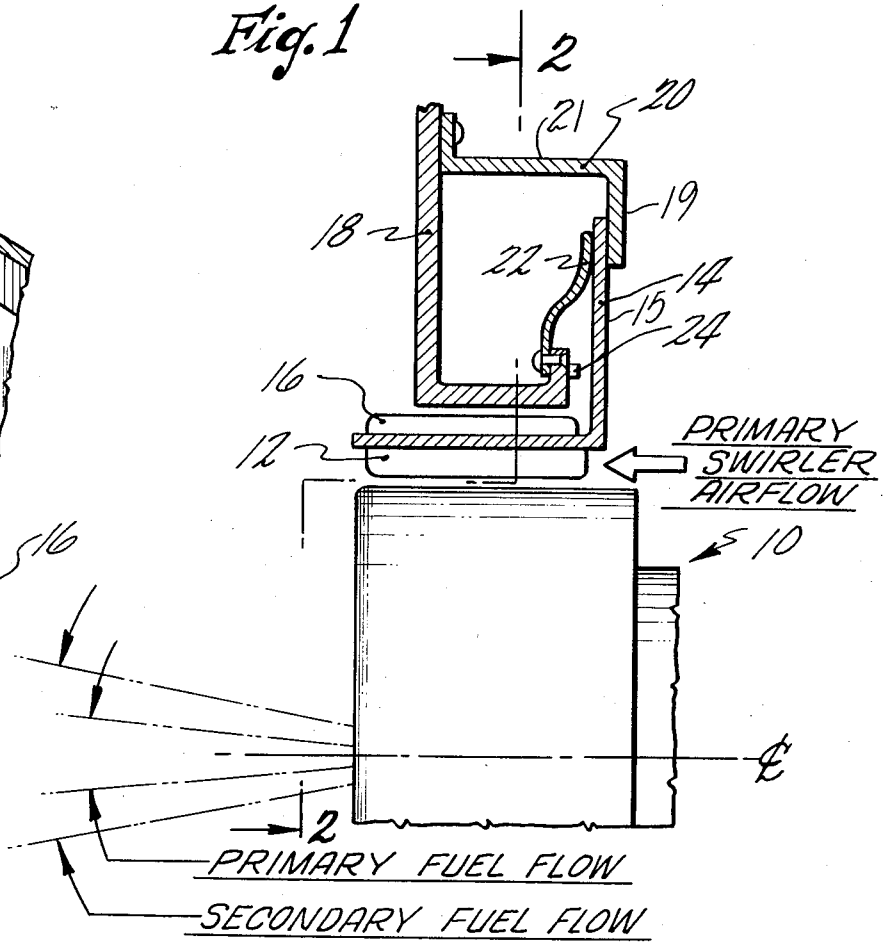
FIG. 1 is a partial view partly in section and partly in elevation, schematically illustrating the invention.

As shown in FIG. 1, the aerating fuel nozzles generally indicated by reference numeral 10, serves to inject primary and secondary fuel into the combustor in accordance with the engine operating envelope. For the sake of convenience and simplicity and because the fuel nozzles are not a part of the invention, a detailed description is omitted herefrom. As schematically shown air from the engine compressor is admitted into the combustor through nozzle inlet guide vanes indicated by reference numeral 12. This constitutes the primary inlet guide vanes and continuously feeds air into the combustor and encircles the fuel spray issuing from the fuel nozzle.

The annular slidable member 14 being L-shaped in cross section surrounds the fuel nozzle 10 and carries primary inlet guide vanes on the inside diameter and secondary guide vanes schematically illustrated by reference numeral 16 on the outside diameter. As noted slidable member 14 fits between the combustor wall 18 and the cover plate 20 attached to combustor wall 18 in a well known manner. The slidable member 14 includes a ring-like portion 15, having an extended portion 17 that engages the depending lip 19 depending from the annular portion 21 of cover 20.

Essentially member 14 serves as a valve biased closed by a plurality of finger springs 22 that are attached at one end to the combustor wall 18. In this embodiment when the pressure differential across member 14 reaches a predetermined value member 14 slides leftwardly to abut against the stop 24 allowing inlet air to enter the combustor through the secondary guide vanes 16 as clearly shown in FIG. 3.

Figure 4:
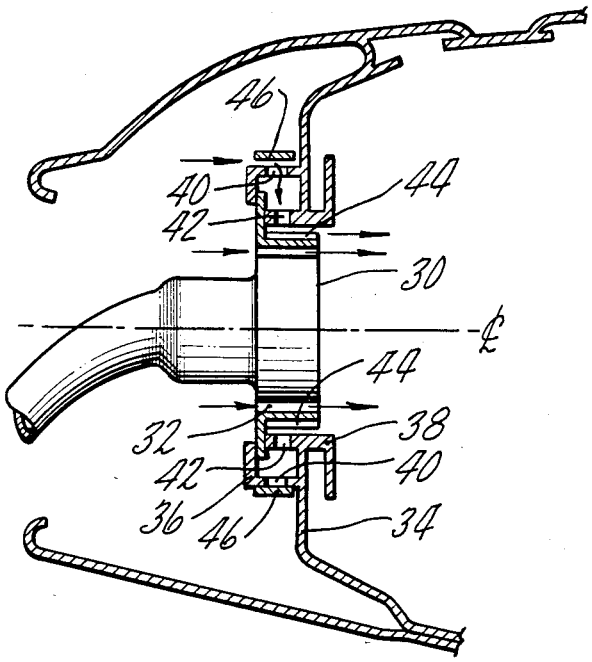
FIG. 4 is a partial view showing the details of another embodiment of the invention.

FIG. 4 exemplifies another embodiment of this invention and utilizes a plurality of bimetallic springs to act as the valve members for admitting secondary air to the secondary guide vanes.

Figure 2:
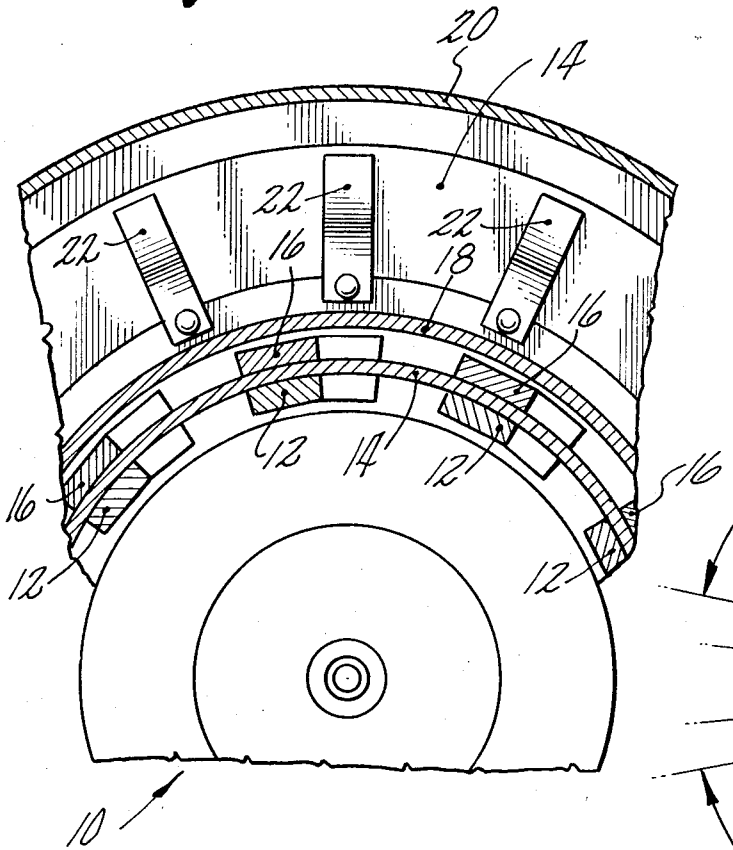
FIG. 2 is a partial view taken along the lines 2—2 of FIG. 1.
Figure 3:
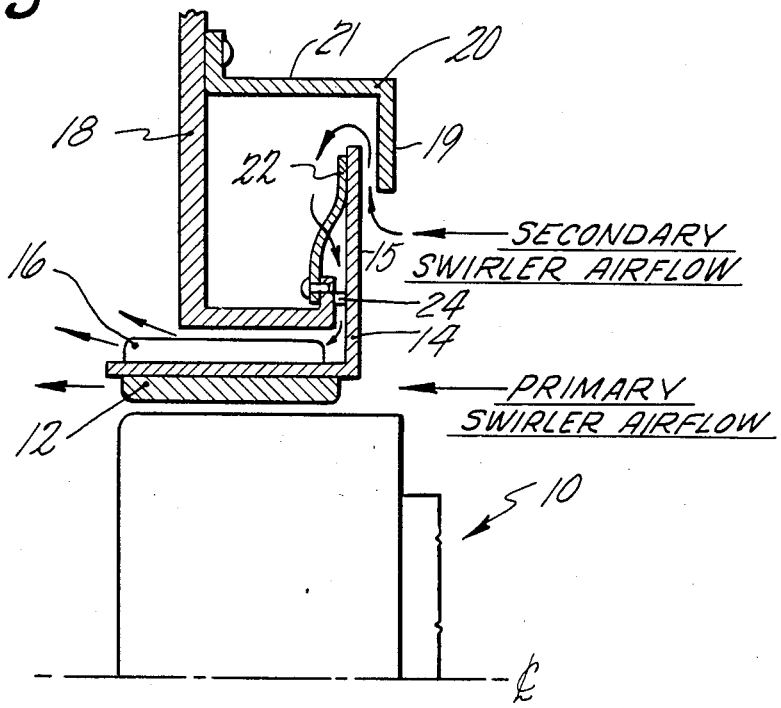
FIG. 3 is a view identical to FIG. 1 showing the valve in the actuated position.
Figure 5:
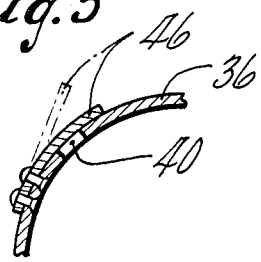
FIG. 5 is a partial view in section showing the attachment of the bimetal valve for the secondary air inlet.

The fuel nozzle 30 and its primary air inlet member 32 are identical to the parts shown in FIGS. 2 and 3. The combustor wall 34 carries a pair of concentric spaced annular wall members 36 and 38 having openings 40 and 42 formed therein for leading compressor air into the secondary air swirler guide vanes 44. As shown in the bottom half of FIG. 4 the bimetal strip 46 is seated against the face of annular wall member 36 overlying opening 40 and blocking air from entering into the secondary guide vanes 44. In the top half of FIG. 4 the bimetal valve element 46 is positioned away from opening 40 allowing compressor air to enter the secondary guide vanes 44. Hence upon reaching the threshold temperature level the bimetal attached at one end by suitable rivets to wall 36 (FIG. 5) bends radially outwardly to unblock the opening 40.

Hence, in the pressure acting embodiment of FIGS. 1 and 3 the finger springs are designed to restrain movement at low engine power conditions when the pressure drop is say 3 psi (pounds per square inch). At the higher engine power conditions the force exerted on member 14 by the increased pressure drop i.e. the pressure upstream and downstream of member 14 which is similar to the pressure upstream and downstream of the combustor overcomes the spring force and moves the secondary guide to the full open position. In the temperature acting embodiment the higher inlet temperatures occasioned by the higher engine power condition opens the inlets to the secondary guide vanes.

By virtue of this invention only small areas for the secondary airflow are necessary, say less than 0.10 square inch per nozzle guide. There is no need for continuous control of the secondary air inlet inasmuch as translation of the valve to full open can occur at any condition above idle. And it can accommodate the large variations in pressure drop that is attendant the engine operation from idle to sea level takeoff conditions.

It should be understood that the invention is not limited to the particular embodiments shown and described herein, but that various changes and modifications may be made without departing from the spirit and scope of this novel concept as defined by the following claims.

We claim:

1. For a gas turbine engine of the type that compresses air ingested thereby said engine having a combustor with a substantially closed front end, an aerating fuel nozzle mounted in an opening in said front end of said combustor for feeding fuel into said combustor, a first set of air inlet guide vanes for feeding air into said combustor in a manner to circumscribe the fuel jet spray issuing from said fuel nozzle, a second set of air inlet guide vanes for issuing air also to circumscribe the fuel jet spray surrounding said first set of air inlet guide vanes, self-actuating valve means solely responsive to the differential pressure upstream of said combustor and downstream of said combustor relative to the flow of air flowing into and out of said combustor for automatically activating said valve means to admit air to said second set of inlet guide vanes upon reaching a predetermined value of said differential pressure, an annular member having a depending lip attached to said front end of said combustor, said self-actuating valve means including a ring-like element having an extended portion subjected to said differential pressure in abutting engagement with said depending lip when said valve is blocking off the flow of air, a plurality of resilient members engaging said extended portion for imparting a force for urging said extended portion in sealing engagement with said depending lip, said pressure differential acting across said extended portion overcoming the force urged by said resilient members to deploy said extended portion away from said depending lip whereby air is admitted to said second inlet guide vanes, whereby said valve means normally blocks off the flow of air to said second inlet guide vanes, said ring-like element partitions said first set of air inlet guide vanes and said second set of air inlet guide vanes.

2. For a gas turbine engine as in claim 1 wherein said resilient means includes a plurality of finger springs having a first end supported to the front end of said combustor and a free end bearing against said extended portion.

* * * * *